US005497682A

United States Patent [19]

Hsu

[11] Patent Number: 5,497,682

[45] Date of Patent: Mar. 12, 1996

[54] TORSION WRENCH

[76] Inventor: Frank Hsu, No. 122, I-Tung Rd., Chien-Kuo Tsun, Tai-Ping Hsiang, Taichung Hsien, Taiwan

[21] Appl. No.: 499,962

[22] Filed: Jul. 10, 1995

[51] Int. Cl.[6] ..... B25B 23/159

[52] U.S. Cl. ..... 81/483; 81/478

[58] Field of Search ..... 81/467, 478, 480, 81/481, 483

[56] References Cited

U.S. PATENT DOCUMENTS

| | | | |
|---|---|---|---|
| 3,772,942 | 11/1973 | Grabovac | 81/483 |
| 4,485,703 | 12/1984 | Grabovac et al. | 81/483 |
| 5,129,293 | 7/1992 | Larson et al. | 81/483 |
| 5,435,190 | 7/1995 | Jansson et al. | 81/483 X |

*Primary Examiner*—D. S. Meislin
*Attorney, Agent, or Firm*—Christensen, O'Connor, Johnson & Kindness

[57] ABSTRACT

A torsion wrench includes a tubular casing, a drive unit pivoted to one end of the casing to engage a workpiece, and an alarm assembly connected to the drive unit for generating an alarm sound when torsion force applied on the workpiece reaches a predetermined limit. The alarm assembly includes a bolt mounted threadably in another end of the casing and rotatable relative to the casing so as to be movable along an axis of the latter to adjust the predetermined limit, and a lock unit for locking the bolt. The lock unit includes a first sleeve sleeved slidably and non-rotatably on the casing and having a retaining end, a second sleeve sleeved slidably and rotatably on the casing and having an engaging end to engage releasably the retaining end, and a tubular handle sleeved on the first and second sleeves and having one end connected to the bolt and another end connected to the second sleeve. The second sleeve is movable along the axis of the casing between a first position, where the engaging end disengages the retaining end to permit rotation of the bolt with the handle, and a second position, where the engaging end engages the retaining end to lock the handle to the casing so as to prevent rotation of the bolt.

8 Claims, 8 Drawing Sheets

TORSION WRENCH

BACKGROUND OF THE INVENTION

1. Field of the Related Art

This invention relates to a torsion wrench for tightening or loosening a workpiece, more particularly to a torsion wrench which has an alarm assembly that can generate an alarm sound when a predetermined torsion force is applied on the workpiece.

2. Description of the Related Art

Generally speaking, when manipulating a torsion wrench to tighten or loosen a workpiece, an operator easily over-tightens or fails to tighten sufficiently the workpiece because an improper torsion force is applied on the workpiece.

Accordingly, there is a conventional torsion wrench which can be adjusted so as to generate an alarm sound when a predetermined torsion force limit is reached in order to overcome the above-described drawback.

The conventional torsion wrench, as shown in FIG. 1, includes a tubular casing 1, a drive unit 2 and an alarm assembly. The drive unit 2 has a head portion (2*a*) that is adapted to engage a workpiece, and a shaft portion (2*b*) that extends into the casing 1 and that is mounted pivotally to an upper end of the casing 1.

The alarm assembly includes a knocker 3 disposed in the casing 1 and connected to a distal end of the shaft portion (2*b*). When the torsion force applied by the drive unit 2 on a workpiece reaches a predetermined limit, the knocker 3 separates from the distal end of the shaft portion (2*b*) to knock on the casing 1, thereby generating an alarm sound. A biasing member 4 is disposed in the casing 1 and has an upper end which abuts against the knocker 3 for biasing the knocker 3 toward the shaft portion (2*b*) to prevent separation of the knocker 3 from the shaft portion (2*b*) when the torsion force applied by the drive unit 2 has not yet reached the predetermined limit. An adjusting unit includes a rod 5 mounted movably in a lower end of the casing 1 and having an upper end that abuts against a lower end of the biasing member 4, and a sleeve member 6 sleeved rotatably on the casing 1 and connected to the rod 5. The rod 5 is movable along an axis of the casing 1 by virtue of rotation of the sleeve member 6 relative to the casing 1 in a known manner so as to adjust initial biasing force of the biasing member 4 to correspond with the predetermined limit.

However, when the conventional torsion wrench is manipulated to actuate a workpiece, the sleeve member 6 is easily rotated by accident. Thus, the rod 5 may be moved to change the initial biasing force of the biasing member 4. As a result, an untimely change in the predetermined limit set on the conventional torsion wrench may occur.

In order to overcome the above-described drawback, there is another conventional torsion wrench, as shown in FIG. 2, which further provides a lock unit 7 for locking the adjusting unit so as to maintain the predetermined limit.

The casing 8 of the conventional torsion wrench has several axially extending grooves (8*a*) formed in an outer peripheral wall thereof. The sleeve member 9 of the conventional torsion wrench has a notch (9*a*) formed in an outer peripheral wall thereof and a hole (9*b*) formed through the outer peripheral wall. It is noted that other parts of the conventional torsion wrench are substantially similar to those of the aforementioned conventional torsion wrench.

The lock unit 7 includes two positioning rings (7*a*, 7*e*), a steel ball (7*b*), a curved and elongated resilient piece (7*c*) (see FIG. 3), and a manipulating ring (7*d*).

Referring to FIG. 3, the steel ball (7*b*) is disposed in the hole (9*b*). The resilient piece (7*c*) has one leg that extends into the notch (9*a*) and another leg that abuts against the steel ball (7*b*). The manipulating ring (7*d*) is sleeved rotatably and non-slidably on the sleeve member 9 and has a circumferential recess (7*d*') formed in an inner wall thereof for receiving the resilient piece (7*c*) therein. The positioning rings (7*a*, 7*e*) (see FIG. 2) are mounted securely on sleeve member 9 to clamp the manipulating ring (7*d*) therebetween. The inner wall of the manipulating ring (7*d*) at the recess (7*d*') has four sections (a, b, c, d). The section (c) is closer to the sleeve member 9 than the sections (a, b, d).

Therefore, the manipulating ring (7*d*) can be rotated to a locking position, as shown in FIG. 4, in which the section (c) depresses the corresponding leg of the resilient piece (7*c*) toward the sleeve member 9 so as to push the steel ball (7*b*) into a corresponding one of the groove (8*a*) of casing 8, thereby connecting the sleeve member 9 to the casing 8. Thus, the sleeve member 9 cannot be rotated relative to the casing 8 to move a threaded rod (8*b*) (see FIG. 2) along the axis of the casing 8 to adjust initial biasing force of a biasing member as described hereinbefore. It is noted that the threaded rod (8*b*) is mounted threadably in a lower end of the casing 8 and has its distal end connected to the sleeve member 9 in a known manner. When the manipulating ring (7*d*) is rotated to an unlocking position, as shown in FIG. 3, the steel ball (7*b*) can be moved away from the corresponding groove (8*a*) so as to permit rotation of the sleeve member 9 relative to the casing 8 and then move correspondingly the threaded rod (8*b*). However, the conventional torsion wrench is complicated in construction and is quite inconvenient to operate.

SUMMARY OF THE INVENTION

Therefore, the main objective of the present invention is to provide a torsion wrench which has an alarm assembly that is simple in construction and that can be easily manipulated to adjust a predetermined limit of the torsion wrench for generating an alarm sound when torsion force applied on a workpiece reaches the predetermined limit.

According to this invention, a torsion wrench for tightening or loosening a workpiece includes a tubular casing, a drive unit and an alarm assembly.

The tubular casing has upper and lower ends.

The drive unit has a head portion which is adapted to engage the workpiece, and a shaft portion which extends into the casing via the upper end and which is mounted pivotally to the casing at the upper end.

The alarm assembly includes a knocker disposed in the casing and connected to a distal end of the shaft portion for knocking on the casing to generate an alarm sound when torsion force applied by the drive unit on the workpiece reaches a predetermined limit, a biasing member disposed in the casing beneath the knocker and having an upper end that abuts against the knocker for biasing the knocker toward the shaft portion to prevent the knocker from knocking on the casing when the torsion force applied by the drive unit has not yet reached the predetermined limit, an adjusting unit for adjusting initial biasing force of the biasing member so as to correspond with the predetermined limit, and a lock unit for locking the adjusting unit to maintain the initial biasing force at an amount corresponding to the predetermined limit.

The adjusting unit includes a bolt member with a head section which is disposed within the casing and which abuts against a lower end of the biasing member, and a shaft section which is mounted threadably in the lower end of the casing. The bolt member is rotatable relative to the casing so as to be movable along an axis of the casing.

The lock unit includes first and second sleeve members, and a tubular handle member. The first sleeve member is sleeved slidably and non-rotatably on the lower end of the casing and has an upper end formed with a retaining portion. The first sleeve member is movable along the axis of the casing. The second sleeve member is sleeved slidably and rotatably on the casing and has a lower end formed with an engaging portion to engage releasably the retaining portion. The tubular handle member is sleeved on the first and second sleeve members and has a lower end connected to the bolt member and an upper end connected to the second sleeve member.

The second sleeve member is movable along the axis of the casing between a first position, in which the engaging portion disengages the retaining portion to permit rotation of the bolt member with the handle member relative to the casing to adjust the initial biasing force of the biasing member, and a second position, in which the engaging portion engages the retaining portion to lock the handle member to the casing so as to prevent rotation of the bolt member relative to the casing.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
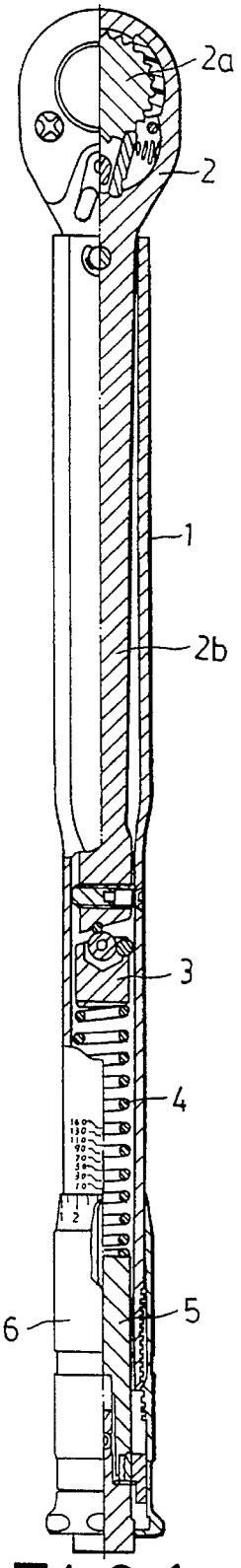
FIG.1 PRIOR ART
FIG. 1 is a schematic view showing a conventional torsion wrench.
Figure 2:
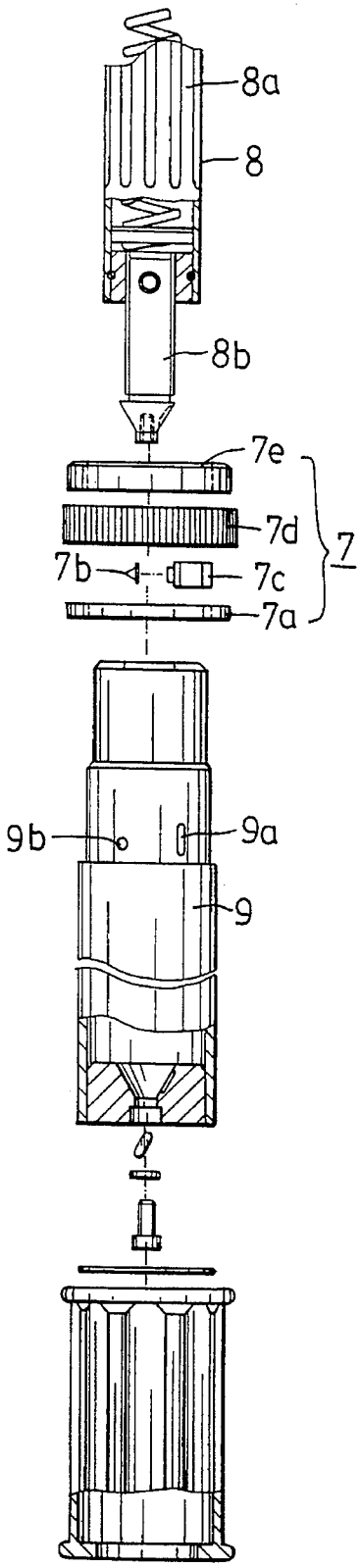
FIG.2 PRIOR ART
FIG. 2 is an exploded view showing another conventional torsion wrench.
Figure 3:
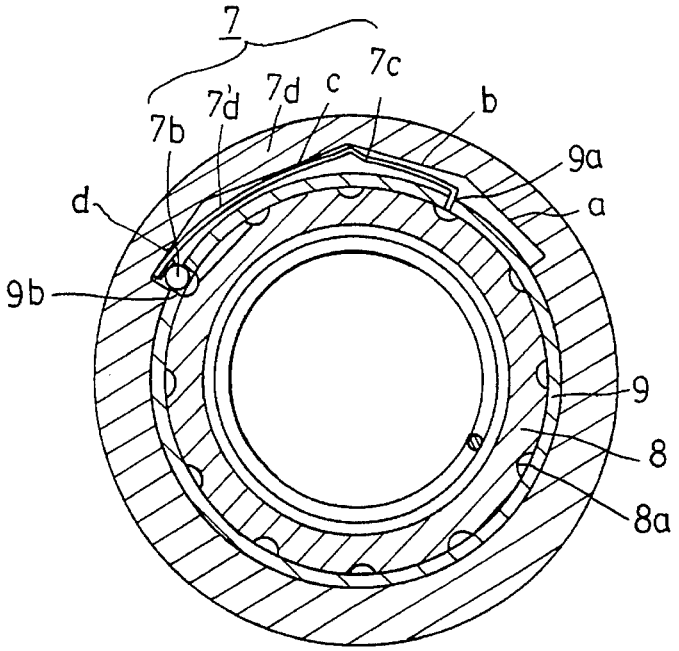
FIG.3 PRIOR ART
FIG. 3 is a sectional view illustrating a lock unit of the conventional torsion wrench of FIG. 2 when in an unlocking position.
Figure 4:
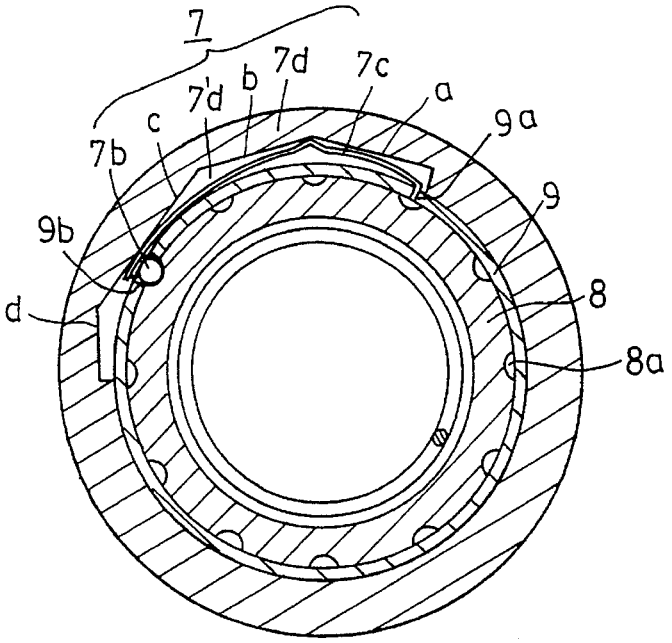
FIG.4 PRIOR ART
FIG. 4 is a sectional view illustrating the lock unit of the conventional torsion wrench of FIG. 2 when in a locking position.
Figure 5:
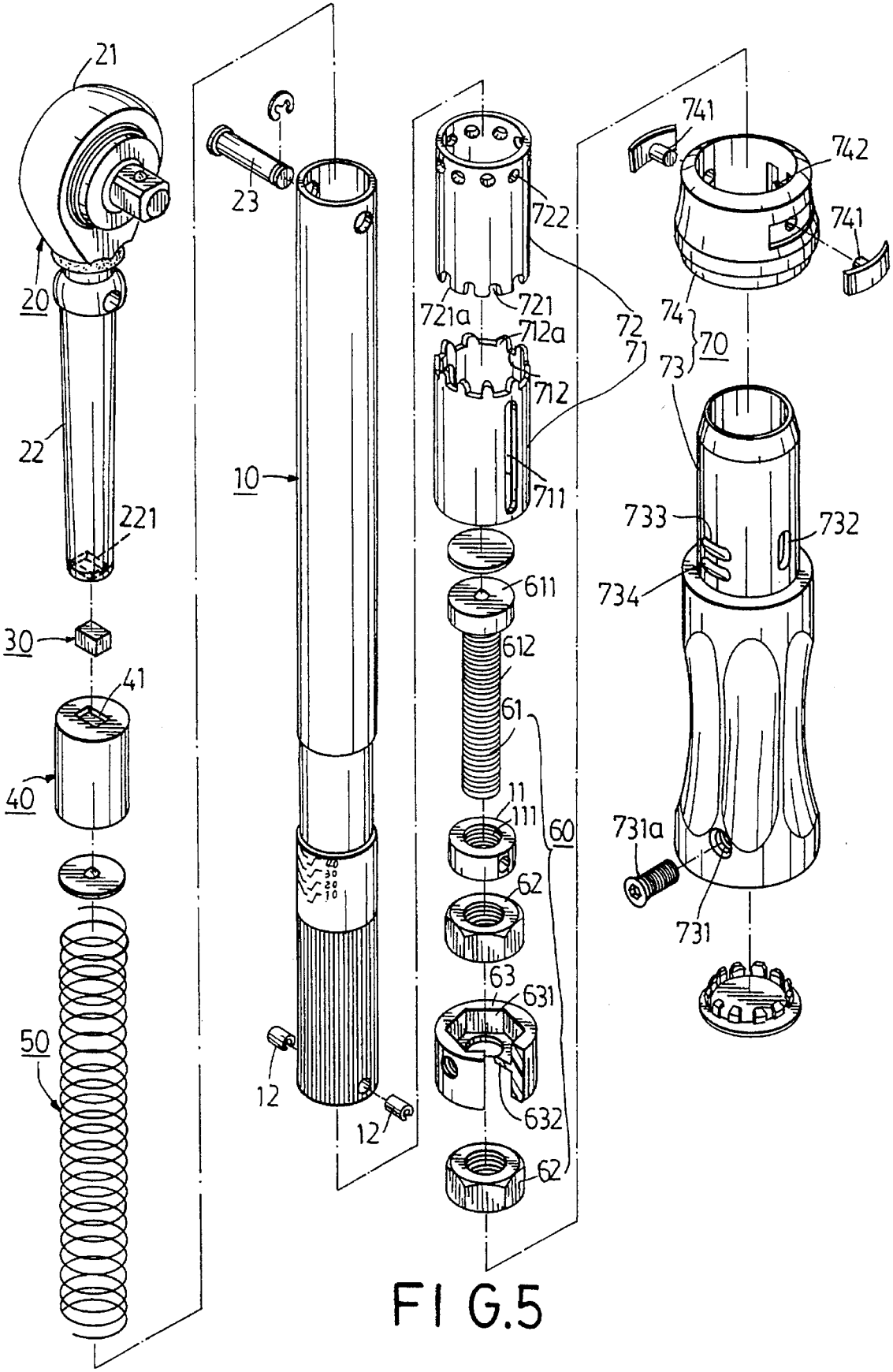
FIG. 5 is an exploded view showing a preferred embodiment of a torsion wrench of this invention.
Figure 6:
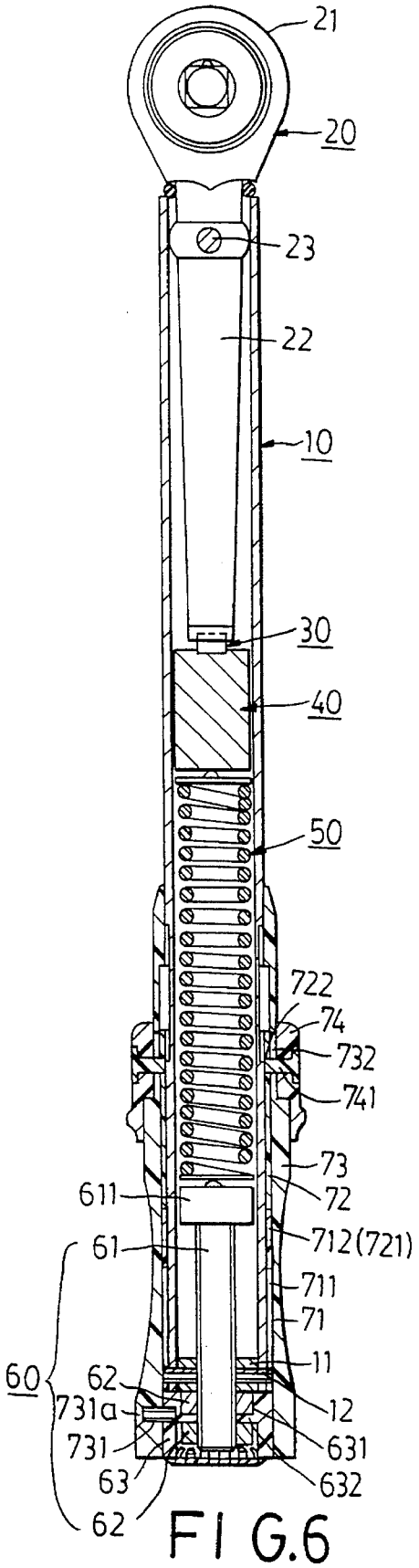
FIGS. 6 and 7 are sectional views showing the torsion wrench of this invention.

Referring to FIGS. 5 and 6, the preferred embodiment of a torsion wrench according to this invention is used for tightening or loosening a workpiece and includes a tubular casing 10, a drive unit 20 and an alarm assembly.

The casing 10 has a nut 11 mounted securely in a lower end thereof by means of two keys 12 that have inner ends extending radially and inwardly through the casing 10 to engage securely the nut 11 and outer ends projecting radially and outwardly from the casing 10.

The drive unit 20 has a head portion 21 which is adapted to engage a workpiece, and a shaft portion 22 which extends into the casing 10 and which is mounted pivotally to an upper end of the casing 10 by means of a pin 23 in a known manner. The shaft portion 22 has a recess 221 formed in a bottom surface thereof. The shaft portion 22 can swing relative to an axis of the casing 10 in a known manner when torsion force applied by the drive unit 20 on a workpiece reaches a predetermined limit.

The alarm assembly includes a connector 30, a knocker 40, a biasing member 50, an adjusting unit 60 and a lock unit 70.

The knocker 40 is disposed in the casing 10 adjacent to the bottom surface of the shaft portion 22 and has a recess 41 formed in a top surface thereof and aligned with the recess 221 of the shaft portion 22.

The connector 30 has a lower portion received in the recess 41 and an upper portion received in the recess 221. Accordingly, swinging of the shaft portion 22 can move the knocker 40 via the connector 30 to knock on the casing 10 to generate an alarm sound in order to warn an operator that the torsion force applied has reached the predetermined limit.

The biasing member 50 in this embodiment is a spring which is disposed in the casing 10 beneath the knocker 40. The biasing member 50 has an upper end abutting against a bottom surface of the knocker 40 for biasing the knocker 40 toward the shaft portion 22 so as to prevent the knocker 40 from knocking on the casing 10 when the torsion force applied by the drive unit 20 has not yet reached the predetermined limit.

The adjusting unit 60 is used for adjusting initial biasing force of the biasing member 50 so as to correspond with the predetermined limit. The adjusting unit 60 includes a bolt member 61, two nuts 62 and a retaining ring 63.

The bolt member 61 has a head section 611 that is disposed within the casing 10 and that abuts against a lower end of the biasing member 50, and an externally threaded shaft section 612 that extends through and that engages an internally threaded portion 111 of the nut 11. Thus, rotation of the shaft section 612 relative to the nut 11 permits the bolt member 61 to move along an axis of the casing 10. At the same time, axial movement of the bolt member 61 can push the biasing member 50 to adjust the initial biasing force of the latter.

The retaining ring 63 is disposed beneath the lower end of the casing 10, and has a hexagonal inner wall 631 and a partition plate 632 that projects radially and inwardly from a middle section of the inner wall 631 to surround a distal end of the shaft section 612 and to divide an interior of the retaining ring 63 into upper and lower portions.

The nuts 62 engage threadably the distal end of the shaft section 612 and are mounted fittingly and respectively in the upper and lower portions of the retaining ring 63 so as to fix the retaining ring 63 to the shaft section 612.

The lock unit 70 is used for locking the adjusting unit 60 to maintain the initial biasing force of the biasing member 50 at an amount corresponding to the predetermined limit. The lock unit 70 includes first and second sleeve members 71, 72, a tubular handle member 73, and a tubular drive member 74.

The first sleeve member 71 is sleeved slidably and non-rotatably on the lower end of the casing 10 and has two axially extending slots 711 (only one is shown in FIG. 5) formed therethrough. The slots 711 allow passage of the outer end portions of the keys 12 therethrough so as to guide movement of the first sleeve member 71 along the axis of the casing 10 and prevent rotation of the first sleeve member 71 on the casing 10. The first sleeve member 71 has an upper end formed with a retraining portion 712 that includes a plurality of axially and upwardly extending teeth (712*a*), and a lower end abutting against a top side of the retaining ring 63. Thus, axial movement of the retaining ring 63 with the bolt member 61 relative to the casing 10 can move the first sleeve member 71 along the axis of the casing 10.

The second sleeve member 72 is sleeved slidably and rotatably on the casing 10, and has an upper end formed with several holes 722 and a lower end formed with an engaging portion 721 which includes a plurality of axially and downwardly extending teeth (721*a*) that engage releasably the teeth (712*a*) of the first sleeve member 71. It is noted that the teeth (712*a*, 721*a*) have curved peripheral edges for facilitating engagement therebetween.

The handle member 73 is sleeved on the first and second sleeve members 71, 72 and the retaining ring 63. The handle member 73 has a lower end formed with a through-hole 731, and an upper end formed with two axially extending through-holes 732 (only one is shown in FIG. 5) and two pairs of axially aligned upper and lower dent portions 733, 734 (only one pair is shown in FIG. 5). A bolt (731*a*) extends through the through-hole 731 to engage securely the retaining ring 63 so as to fix the retaining ring 63 to the handle member 73.

The drive member 74 is sleeved slidably and non-rotatably on the upper end of the handle member 73. The drive member 74 includes two pins 741 projecting radially and inwardly therefrom in a known manner to extend respectively through the through-holes 732 of the handle member 73 and then engage securely and respectively corresponding two of the holes 722 of the second sleeve member 72. In this way, the second sleeve member 72 can be connected to the drive member 74. The through-holes 732 can guide axial movement of the pins 741 therein so as to permit the drive member 74 to move along an axis of the handle member 73 and prevent rotation of the drive member 74 relative to the handle member 73. Thus, the second sleeve member 72 can be moved along the axis of the casing 10 between a first position (an unlocking position) and a second position (a locking position) by virtue of axial movement of the drive member 74.

Figure 7:
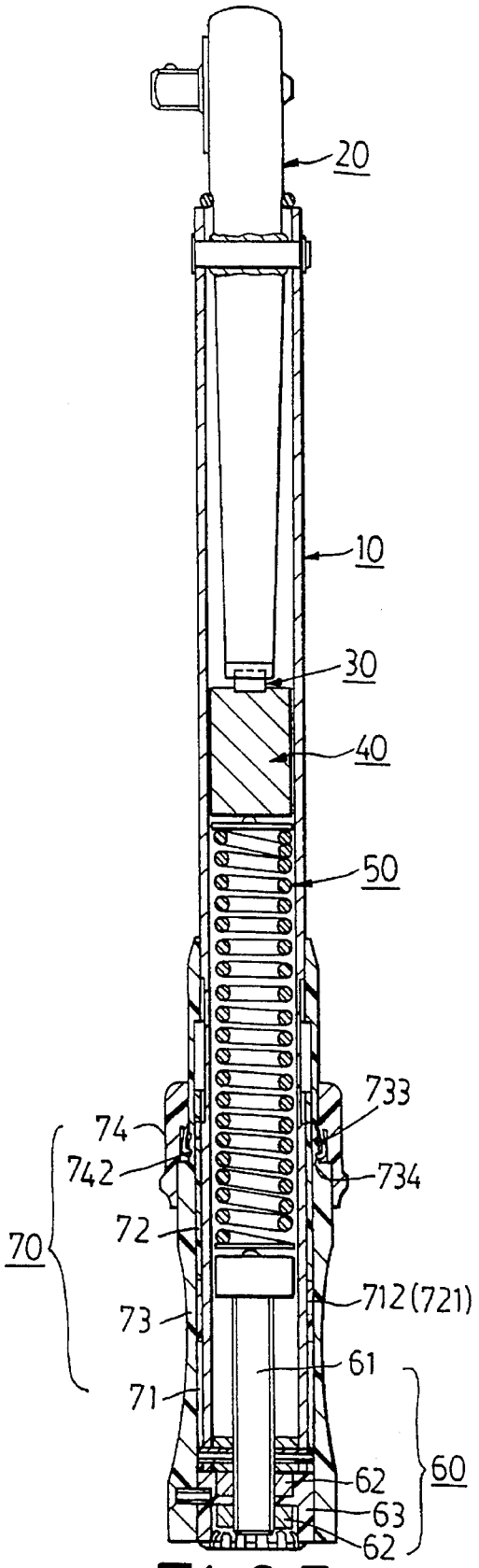

Referring to FIGS. 5 and 7, the drive member 74 further includes two resilient pieces 742 (only one is shown in FIG. 5) which project radially and inwardly therefrom. The resilient pieces 742 engage releasably and respectively the upper dent portions 733 of the handle member 73 so as to maintain the second sleeve member 72 at the first position, and engage releasably and respectively the lower dent portions 734 so as to maintain the second sleeve member 72 at the second position.

Figure 8:
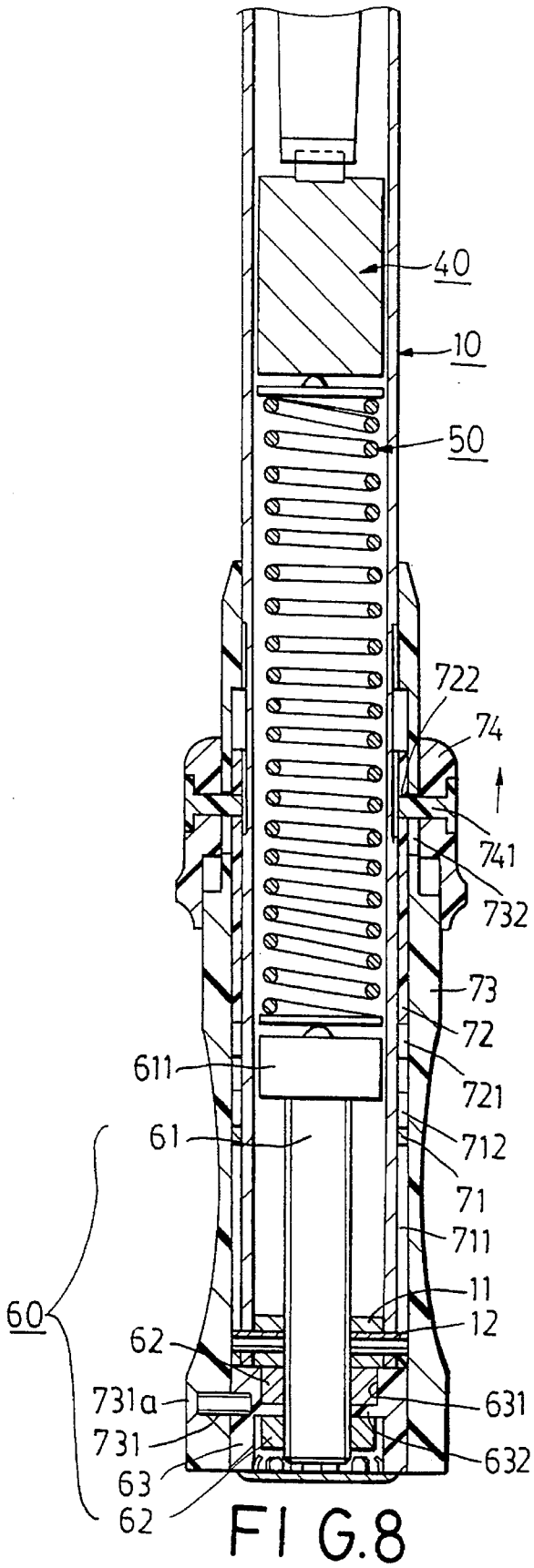
FIG. 8 is a schematic view illustrating how a lock unit of the torsion wrench is operated to an unlocking position in accordance with this invention.
Figure 9:
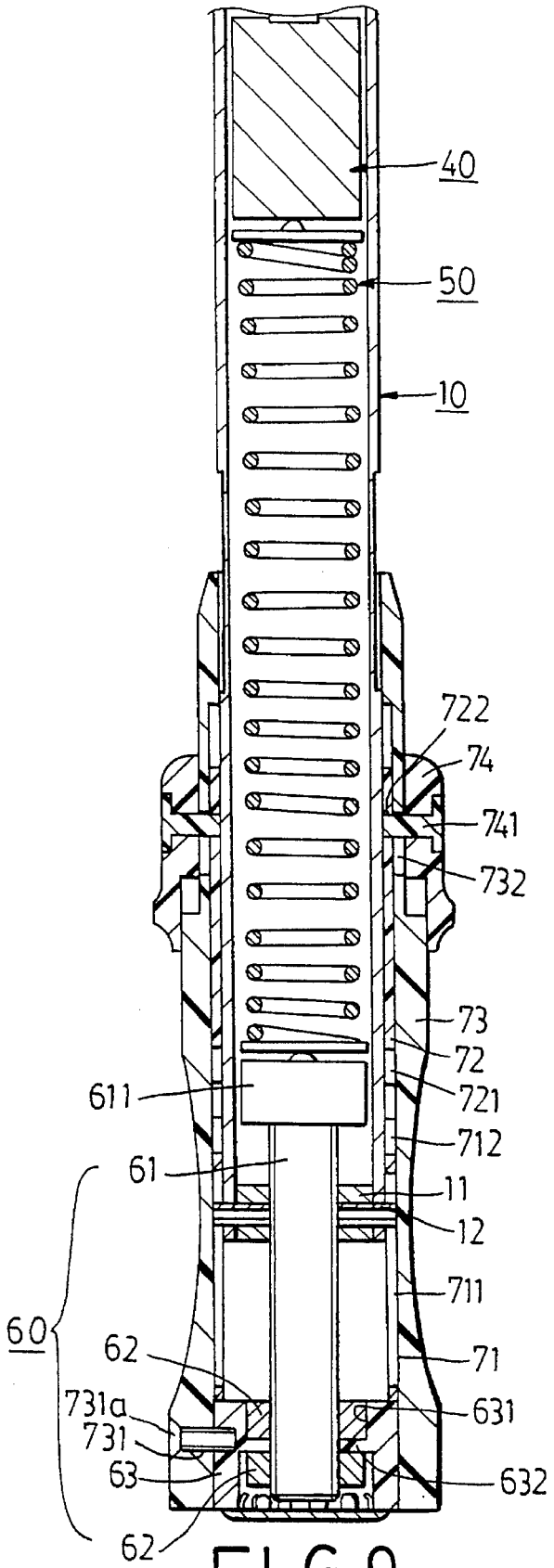
FIG. 9 is a schematic view illustrating how an adjusting unit of the torsion wrench is operated to adjust a predetermined torsion force limit after the lock unit is moved to the unlocking position.

Referring to FIG. 8, when at the first position, the engaging portion 721 of the second sleeve member 72 disengages the retaining portion 712 of the first sleeve member 71 to permit rotation of the handle member 73 with the second sleeve member 72 relative to the casing 10. Rotation of the handle member 73 can rotate the retaining ring 63 so as to rotate simultaneously the bolt member 61 relative to the casing 10 and then move the bolt member 61 along the axis of the casing 10, as shown in FIG. 9. In this way, the initial biasing force of the biasing member 50 can be adjusted to correspond with the predetermined limit.

When at the second position, the engaging portion 721 of the second sleeve member 72 engages the retaining portion 712 of the first sleeve member 71 to prevent rotation of the second sleeve member 72 relative to the casing 10. Thus, the handle member 73 cannot be rotated relative to the casing 10 when the torsion wrench is applied to actuate a workpiece. In this way, the bolt member 61 can be fixed to the nut 11 of the casing 10 to maintain the initial biasing force of the biasing member 50 at the predetermined limit.

While the present invention has been described in connection with what is considered the most practical and preferred embodiment, it is understood that this invention is not limited to the disclosed embodiment but is intended to cover various arrangements included within the spirit and scope of the broadest interpretations and, equivalent arrangement.

I claim:

1. A torsion wrench for tightening or loosening a workpiece, the torsion wrench including a tubular casing having upper and lower ends, a drive unit having a head portion which is adapted to engage the workpiece, and a shaft portion which extends into said casing via said upper end and which is mounted pivotally to said casing at said upper end, and an alarm assembly including a knocker disposed in said casing and connected to a distal end of said shaft portion for knocking on said casing to generate an alarm sound when torsion force applied by said drive unit on the workpiece reaches a predetermined limit, a biasing member disposed in said casing beneath said knocker and having an upper end that abuts against said knocker for biasing said knocker toward said shaft portion to prevent said knocker from knocking on said casing when the torsion force applied by said drive unit has not yet reached the predetermined limit, an adjusting unit for adjusting initial biasing force of said biasing member so as to correspond with the predetermined limit, and a lock unit for locking said adjusting unit to maintain the initial biasing force at an amount corresponding to the predetermined limit, wherein the improvement comprises:

said adjusting unit including a bolt member with a head section which is disposed within said casing and which abuts against a lower end of said biasing member, and a shaft section which is mounted threadably in said lower end of said casing, said bolt member being rotatable relative to said casing so as to be movable along an axis of said casing;

said lock unit including: a first sleeve member which is sleeved slidably and non-rotatably on said lower end of said casing and which has an upper end formed with a retaining portion, said first sleeve member being movable along said axis of said casing; a second sleeve member which is sleeved slidably and rotatably on said casing and which has a lower end formed with an engaging portion to engage releasably said retaining portion; and a tubular handle member which is sleeved on said first and second sleeve members and which has a lower end connected to said bolt member and an upper end connected to said second sleeve member;

said second sleeve member being movable along said axis of said casing between a first position, in which said engaging portion disengages said retaining portion to permit rotation of said bolt member with said handle member relative to said casing to adjust the initial biasing force of said biasing member, and a second position, in which said engaging portion engages said retaining portion to lock said handle member to said casing so as to prevent rotation of said bolt member relative to said casing.

2. A torsion wrench as claimed in claim 1, wherein said casing includes a nut mounted securely in said lower end thereof, said nut engaging threadably said shaft section of said bolt member.

3. A torsion wrench as claimed in claim 1, wherein said adjusting unit further includes a retaining ring disposed beneath said lower end of said casing and mounted securely and fittingly in said lower end of said handle member, and two nuts engaging a distal end of said shaft section of said bolt member, said nuts being mounted securely and respectively in upper and lower portions of said retaining ring so as to fix said retaining ring to said shaft section, said retaining ring having a top side abutting against a lower end of said first sleeve member.

4. A torsion wrench as claimed in claim 1, wherein said first sleeve member has an axially extending slot and said casing has a key that projects radially and outwardly therefrom and that extends into said slot to guide axial movement of said first sleeve member on said casing.

5. A torsion wrench as claimed in claim 1, wherein said upper end of said handle member is formed with an axially extending through-hole, said lock unit further including a tubular drive member provided movably around said upper end of said handle member, said drive member having a pin that projects radially and inwardly therefrom to extend through said through-hole and to engage securely said second sleeve member, said pin being slidable along said through-hole by virtue of movement of said drive member so as to move said second sleeve member between said first and second positions.

6. A torsion wrench as claimed in claim 5, wherein said upper end of said handle member is formed with axially aligned upper and lower dent portions, said drive member having a resilient piece that projects radially and inwardly therefrom to engage selectively and releasably one of said upper and lower dent portions so as to maintain said second sleeve member at one of said first and second positions.

7. A torsion wrench as claimed in claim 1, wherein said retaining portion includes a plurality of axially and upwardly extending first teeth, said engaging portion including a plurality of axially and downwardly extending second teeth that engage releasably said first teeth.

8. A torsion wrench as claimed in claim 1, further comprising a connector disposed between said knocker and said shaft portion of said drive unit, said knocker having a first recess formed in a top surface thereof to receive a lower portion of said connector, said shaft portion having a second recess formed in a bottom surface thereof and aligned with said first recess to receive an upper portion of said connector, said shaft portion swinging relative to said axis of said casing against action of said biasing member when the torsion force applied by said drive unit reaches the predetermined limit so as to move said knocker via said connector to knock on said casing.

* * * * *